US005567183A

United States Patent [19]

Sano

[11] Patent Number: 5,567,183

[45] Date of Patent: Oct. 22, 1996

[54] TERMINAL RETAINING CONNECTOR

[75] Inventor: Takahiro Sano, Shizuoka, Japan

[73] Assignee: Yazaki Corporation, Tokyo, Japan

[21] Appl. No.: 459,626

[22] Filed: Jun. 2, 1995

Related U.S. Application Data

[63] Continuation of Ser. No. 171,624, Dec. 22, 1993, abandoned.

[30] Foreign Application Priority Data

Dec. 24, 1992 [JP] Japan ..... 4-344034

[51] Int. Cl.[6] ..... H01R 13/42

[52] U.S. Cl. ..... 439/751

[58] Field of Search ..... 439/246, 751, 439/752, 873

[56] References Cited

U.S. PATENT DOCUMENTS

| | | | |
|---|---|---|---|
| 3,670,294 | 6/1972 | Johnson et al. | 439/751 X |
| 4,966,557 | 10/1990 | Barkus et al. | 439/751 X |
| 4,975,066 | 12/1990 | Sucheski et al. | 439/751 X |
| 4,993,975 | 2/1991 | Asick et al | 439/751 X |
| 5,139,446 | 8/1992 | Costello et al. | 439/751 X |
| 5,249,980 | 10/1993 | Hatagishi | 439/751 X |

FOREIGN PATENT DOCUMENTS 2-278673 11/1990 Japan .

*Primary Examiner*—P. Austin Bradley
*Assistant Examiner*—Daniel Wittels
*Attorney, Agent, or Firm*—Sughrue, Mion, Zinn, Macpeak & Seas

[57] ABSTRACT

A terminal retaining connector capable of temporarily retaining a male terminal inside a connector housing or releasing the male terminal from the connector housing manually with ease. In the terminal retaining connector wherein an inserting hole for an electric contact portion of a male terminal is arranged in a front wall of a terminal accommodating chamber of a connector housing; and a pair of rising strips formed integrally with the electric contact portion of the male terminal and an electric wire connecting portion are accommodated in the terminal accommodating chamber. In such terminal retaining connector, an outer width between outer side top end portions of the pair of rising strips is set to a value equal to or greater than an inner width of the terminal accommodating chamber so that the outer side top end portions of the rising strips can be brought into pressure contact with inner side walls of the terminal accommodating chamber; and the inner side walls are made so thin as to be flexible.

3 Claims, 2 Drawing Sheets

TERMINAL RETAINING CONNECTOR

This is a continuation of application Ser. No. 08/171,624, filed Dec. 22, 1993, now abandoned.

BACKGROUND OF THE INVENTION

1. Field of the Invention

The invention relates to a terminal retaining connector capable of temporarily retaining or releasing a male terminal inside a connector housing easily with fingers of a hand.

2. Related Art

FIG. 7 is a longitudinal sectional view showing a conventional connector disclosed in Japanese Patent Unexamined Publication No. 2-278673.

The connector 20 includes: an inner housing 22 for fixing a male terminal 21 by pressing; an outer housing 23 that covers the inner housing 22; and a seal resin 25 that is filled on the side of an electric wire connecting portion 24 of the male terminal 21.

The male terminal 21 has a pair of projections 27, 27 on a base portion of a tab portion 26 serving as an electric contact portion. The projections 27, 27 are fixed by cutting into the inner surface of an inserting hole 30, with the tab portion 26 inserted into the inserting hole 30 arranged in a front wall 29 of a terminal accommodating chamber 28 of the inner housing 22 by pressing.

However, the conventional structure not only requires a tool dedicated to the insertion of the male terminal 21 by pressing, but also imposes difficulty in extracting the male terminal 21 when a user wishes to release the male terminal 21 because of defective insertion or for maintenance, etc. In addition, once extracted, the male terminal 21 cannot be inserted by pressing again because the inner surface of the inserting hole 30 has been worn.

SUMMARY OF THE INVENTION

The invention has been made in view of the above circumstances. Accordingly, the object of the invention is to provide a connector that facilitates male terminal insertion and retention as well as extraction with respect to a connector terminal, and that allows the once extracted male terminal to be inserted and retained again.

To achieve the above object, the invention is applied to a terminal retaining connector wherein an inserting hole for an electric contact portion of a male terminal is arranged in a front wall of a terminal accommodating chamber of a connector housing; and a pair of rising strips formed integrally with the electric contact portion of the male terminal and an electric connecting portion are accommodated in the terminal accommodating chamber, wherein an outer width between outer side top end portions of the pair of rising strips is set to a value equal to or greater than an inner width of the terminal accommodating chamber so that the outer side top end portions can be brought into pressure contact with inner side walls of the terminal accommodating chamber; and that the inner side walls are made so thin as to be flexible.

At the time of inserting the male terminal, the outer side top end portions of the rising strips are brought into pressure contact with the inner side walls of the accommodating chamber. As a result, the male terminal is temporarily retained. Since the inner side walls are flexed, the rising strips do not scrape the inner side walls. The male terminal can be regularly retained by a rear holder or the like.

DETAILED DESCRIPTION OF THE PREFERRED EMBODIMENTS

Figure 1:
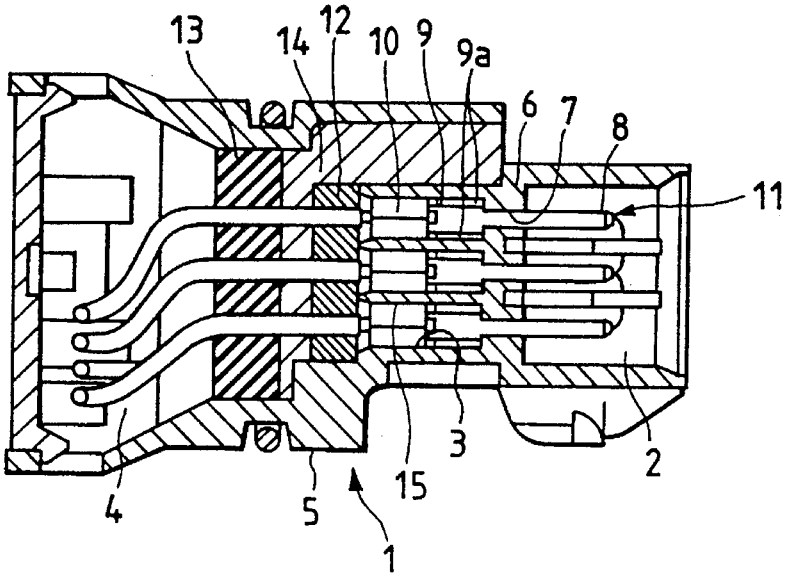
FIG. 1 is a longitudinal sectional view of a terminal retaining connector, which is an embodiment of the present invention.
Figure 2:
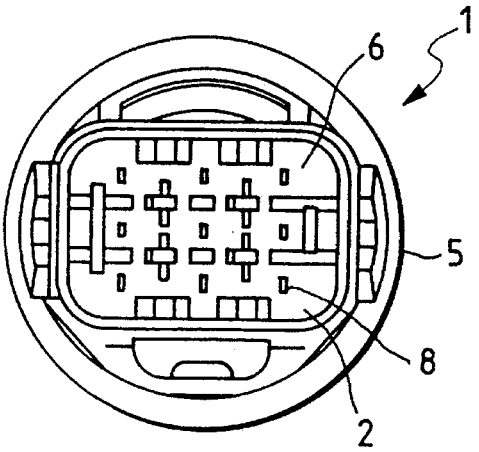
FIG. 2 is a front view of the embodiment of the present invention.
Figure 3:
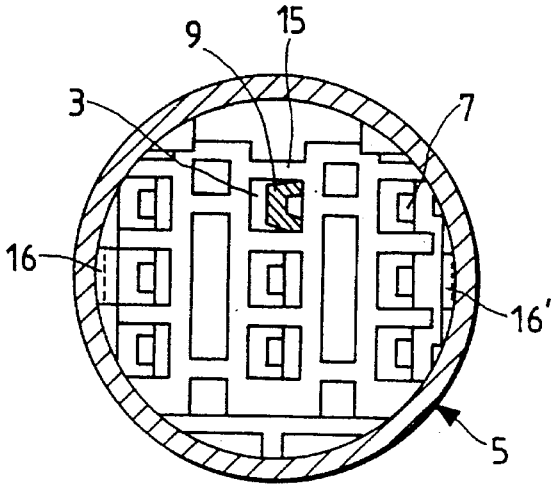
FIG. 3 is a rear view of a connector housing of the present invention.

FIG. 1 is a longitudinal sectional view of a terminal retaining connector, which is an embodiment of the invention; FIG. 2 is A front view thereof; and FIG. 3 is a rear view of a connector housing.

The terminal retaining connector 1 is generally attached to a transmission section of an automobile and mainly includes: a counterpart connector engaging chamber 2 in the front; a connector housing 5; a male terminal 11; a rear holder 12; a waterproof rubber stopper 13; and a seal resin 14. The connector housing 5 is made of a synthetic resin, and has a plurality of terminal accommodating chambers 3 in the middle and electric wire inserting chambers 4 in the rear. The male terminal 11 has a tab portion 8, a pair of rising strips 9, 9, and an electric wire crimping portion 10. The tab portion 8, serving as an electric contact portion, is inserted, not by pressing, into an inserting hole 7 arranged in a front wall 6 of the terminal accommodating chambers 3. The rising strips 9, 9 are accommodated in the terminal accommodating chamber 3. The rear holder 12 is made of a synthetic resin, and abuts against the electric wire crimping portion 10 of the male terminal 11. The waterproof rubber stopper 13 is attached to the rear portion of the rear holder 12. The seal resin 14 is filled between the electric wire crimping portion 10 and the rubber stopper 13.

The tab portion 8 of each male terminal 11 is projected into the counterpart connector engaging chamber 2 of the housing 5 as shown in FIG. 2 from the inserting hole 7 arranged in the terminal accommodating chamber front wall 6. The clearance between the tab portion 8 and the inserting hole 7 is set to either zero or more, allowing the tab portion 8 to pass therethrough with little resistance.

Figure 4:
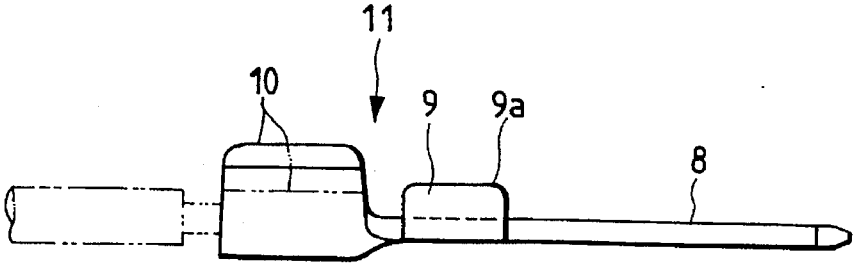
FIG. 4 is a side view of a male terminal of the present invention.
Figure 5:
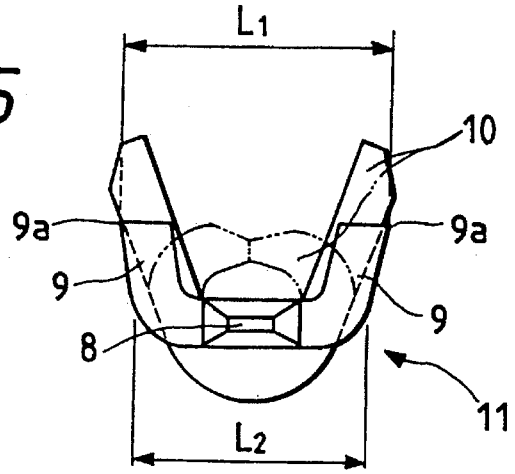
FIG. 5 is a front view of the male termainal of the present invention.
Figure 6:
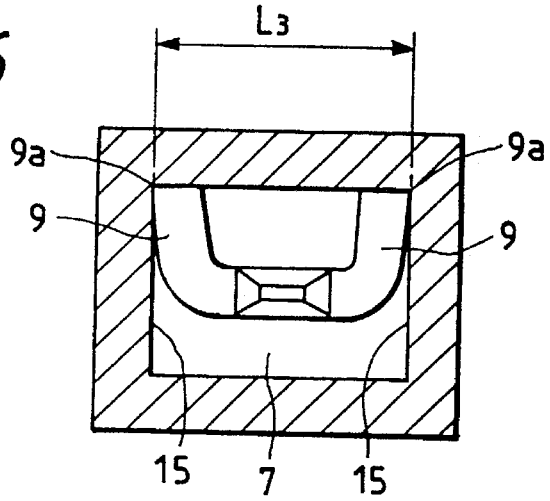
FIG. 6 is a longitudinal sectional view of the male terminal being inserted into a terminal accommodating chamber.
Figure 7:
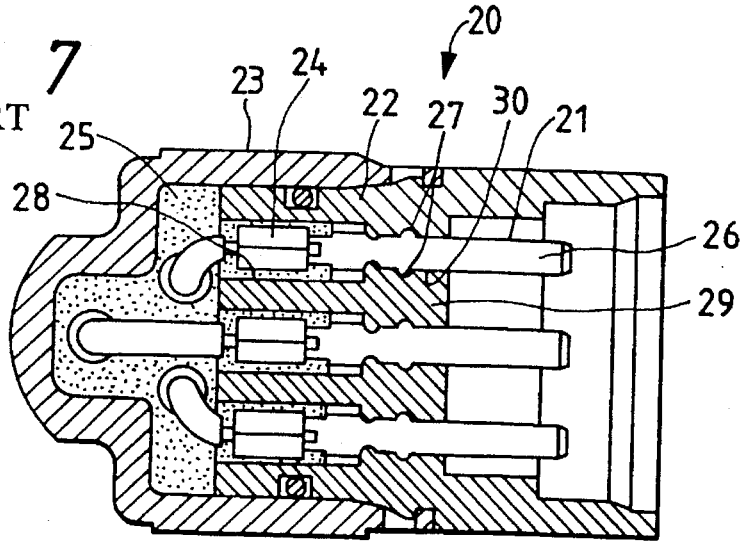
FIG. 7 PRIOR ART
FIG. 7 is a longitudinal sectional view of a conventional example.

As shown in the side view of FIG. 4 and in the front view of FIG. 5, both showing the male terminal 11, the pair of rising strips 9, 9, are formed integrally with a base end of the tab portion 8 so as to be U-shaped with the top width wider than the base width thereof. An outer width $L_1$ between top end portions **9*a* is set to a value greater than an outer width $L_2$ of the base end portion. The outer width $L_1$ between the top end portions 9*a* is set to a value equal to or greater than an inner width $L_3$ of the terminal accommodating chamber 3 as shown in FIG. 6, which shows the rising strips 9, 9 being inserted into the terminal accommodating chamber 3. The outer side top end portions 9*a*, 9*a* of the respective rising strips 9, 9 are designed so as to be brought into pressure contact with inner side walls 15, 15 of the terminal accommodating chamber 3**.

Therefore, the rising strips 9, 9 are inserted into the terminal accommodating chamber 3 with a certain degree of sliding resistance, thus not allowing the male terminal 11 to come out by its own weight even if the insertion of the rising strips 9, 9 is stopped. The resiliency between the accommodating chamber inner side walls 15, 15 is set to such a value as to allow the rising strips 9, 9 to be inserted easily with fingers of a hand. As shown by chain lines in FIGS. 4 and 5, the electric wire crimping portion 10 becomes lower and caulked so as to be narrower than the rising strips 9, 9 when crimped, so that the electric wire crimping portion 10 never comes in slidable contact with the accommodating chamber inner side walls 15, 15 once crimped.

The inner side wall 15 of the terminal accommodating chamber 3 is made thin as shown in FIGS. 3 and 6, and is flexible outwardly when brought into pressure contact with the outer side top end portion 9*a* of the rising strip 9. Therefore, the inner side wall 15 is never scraped by the rising strip 9 sliding over the wall 15, thereby ensuring that the friction between the rising strips and chamber walls will not be reduced even if the rising strip 9 is inserted and extracted as many times as the user wishes.

The male terminal 11 is temporarily retained inside the housing 5 by the pressure contact resistance of the rising strip 9, and is regularly retained when the rear holder 12 is inserted. The rear holder 12 is releasably inserted by retaining pawls 16, 16' shown in FIG. 3. When the rubber stopper 13 has been inserted and the seal resin 14 filled, the assembling of the connector 1 is completed. The structure of this embodiment is particularly effective when applied to a case where there is no space for a terminal retaining lance (not shown) inside the connector housing 5.

As described in the foregoing, according to the invention, the male terminal can easily be temporarily inserted and retained in the terminal accommodating chamber and released therefrom as many time as the user wishes with fingers of his hand without any tools. Therefore, the connector can be reassembled with ease at the time of defective insertion of the terminal, maintenance, or the like, thus providing convenience and economy. Further, the connector housing can be made compact by thinning the inner walls of the terminal accommodating chamber.

What is claimed is:

1. A terminal retaining connector, comprising:

a connector housing having a terminal accommodating chamber defined by opposing side walls separated from one another by a first distance; and a male terminal receivable in said terminal accommodating chamber, said male terminal including a base plate and a pair of bent, elastic, deflecting arms extending upwardly from opposite sides of said base plate in a U-shaped manner, outermost surfaces of said arms being separated by a second distance which is greater than said first distance, wherein when said male terminal is inserted into said accommodating chamber said arms are deflected inwardly toward each other so that after insertion said outermost surfaces of said arms respectively abut against said side walls of said housing in a spring-like manner and in a face-to-face relationship to positively position and retain said terminal within said accommodating chamber.

2. The terminal retaining connector of claim 1, wherein said connector housing includes a stepped portion formed in said terminal accommodating chamber against which said arms abut when said terminal is inserted therein so as to longitudinally position said terminal in said accommodating chamber.

3. The terminal retaining connector of claim 1, wherein said side walls are flexible so as to be capable of expanding outwardly upon insertion of said terminal into said terminal accommodating chamber.

* * * * *